United States Patent [19]

Miller et al.

[11] 4,372,100

[45] Feb. 8, 1983

[54] PROCESS AND APPARATUS FOR COMPOUNDING HYPERALIMENTATION SOLUTIONS

[75] Inventors: Robert A. Miller, Crystal Lake, Ill.; Kenneth W. Larson, Keene, N.H.; Joseph L. Schopen, Crystal Lake, Ill.

[73] Assignee: Baxter Travenol Laboratories, Inc., Deerfield, Ill.

[21] Appl. No.: 331,495

[22] Filed: Dec. 17, 1981

Related U.S. Application Data

[63] Continuation-in-part of Ser. No. 90,234, Nov. 1, 1979, abandoned.

[51] Int. Cl.[3] ..... B65B 3/06; B65B 3/26

[52] U.S. Cl. ..... 53/428; 53/469; 53/474; 53/512; 128/214 R; 141/105; 141/286; 366/162; 366/173; 366/174; 366/337

[58] Field of Search ..... 53/428, 434, 469, 474, 53/512, 111 R; 128/214 R, 214 C, 214 D, 214.2; 366/160, 162, 173, 174, 182, 337; 127/14, 21, 55; 222/129, 145; 137/602, 604, 605, 606, 808, 809, 4, 92, 205; 141/105, 286, 9, 10, 114, 313

[56] References Cited

U.S. PATENT DOCUMENTS

| | | | |
|---|---|---|---|
| 1,135,658 | 4/1915 | Bartlett . | |
| 1,205,743 | 11/1916 | Hoke . | |
| 1,408,591 | 3/1922 | Hamilton | 366/162 |
| 2,198,325 | 8/1959 | Wynn et al. | 137/92 X |
| 2,879,207 | 3/1959 | Poitras . | |
| 2,901,112 | 8/1959 | Naftulin . | |
| 2,954,028 | 9/1960 | Smith . | |
| 3,197,285 | 7/1965 | Rosen . | |
| 3,217,711 | 11/1963 | Pecina . | |
| 3,298,597 | 1/1967 | Bellamy . | |
| 3,595,231 | 7/1971 | Pistor . | |
| 3,635,798 | 1/1972 | Kirkham et al. . | |
| 3,675,780 | 7/1972 | Marshall . | |
| 3,709,635 | 1/1973 | Czaplinski . | |
| 3,722,557 | 3/1973 | Huggins | 141/59 |
| 3,730,353 | 5/1973 | Trasen . | |
| 3,756,237 | 9/1973 | Chittenden et al. | 128/214 R X |
| 3,941,126 | 3/1976 | Dietrich . | |
| 3,986,506 | 10/1976 | Garber et al. . | |
| 4,009,714 | 3/1975 | Hammer . | |
| 4,036,698 | 7/1977 | Bush . | |
| 4,068,830 | 1/1978 | Gray | 366/174 |
| 4,073,691 | 2/1978 | Ahnell . | |
| 4,116,646 | 9/1978 | Edwards . | |
| 4,177,149 | 12/1979 | Rosenberg . | |
| 4,191,183 | 3/1980 | Mendelson | 128/214 R |
| 4,223,675 | 9/1980 | Williams . | |
| 4,235,233 | 11/1980 | Mouwen . | |
| 4,265,760 | 5/1981 | Abel et al. . | |

FOREIGN PATENT DOCUMENTS 1543404 4/1979 United Kingdom .

OTHER PUBLICATIONS

Hunt and Latiolais, Travenol Laboratories, Inc. Training Manual for Central Intravenous Admixture Personnel (1976), p. 93.

*Primary Examiner*—Horace M. Culver

*Attorney, Agent, or Firm*—John P. Kirby, Jr.; Bradford R. L. Price; George H. Gerstman

[57] ABSTRACT

A process and apparatus for mixing at least two parenteral solutions, sterilizing the resulting mixture, and transferring the sterilized mixture into an extensible, plastic receiving bag. The apparatus includes a mixing chamber into which the solutions can be delivered, a bacterial organism retentive filter for sterilizing the mixture of the solutions received from the chamber, such a receiving bag, tubing for transferring each of the solutions to be chamber, and second tubing for transferring the sterilized mixture from the filter to the bag. All are combined and then sterilized as a unit. In one embodiment of the invention, the bag is placed in a vacuum chamber to facilitate transfer of the mixture through the apparatus and the mixing chamber has a baffle or system of baffles for creating turbulence in the solutions while they are being mixed. The diameter and length of each tubing leading into the chamber from a solution holding container is preselected with respect to the viscosity of the solution in that holding container, so that both solutions reach the chamber at the same time or in a selected order and are mixed in an equal or preselected proportion therein.

8 Claims, 3 Drawing Figures

PROCESS AND APPARATUS FOR COMPOUNDING HYPERALIMENTATION SOLUTIONS

BACKGROUND OF THE INVENTION

This application is a continuation-in-part of our U.S. patent application, Ser. No. 90,234, filed Nov. 1, 1979 and now abandoned.

The present invention pertains to a process and apparatus for mixing, sterilizing and transferring solutions. More particularly, it pertains to such a process and apparatus useful for the compounding of hyperlimentation solutions.

Hyperlimentation therapy is the intravenous feeding of, for example, a protein-carbohydrate mixture to a patient. It is used primarily to meet his protein and caloric requirements which are unable to be satisfied by oral feeding. The protein may be in the form of freeamino acids or protein hydrolysate and the carbohydrate commonly is dextrose. In addition to the protein and carbohydrate, vitamins (water-soluble and fat-soluble) and electrolytes can also be supplied in this therapy.

Each of these parenteral ingredients and the combination thereof are particularly susceptible to the growth of deleterious organisms and it is desirable that they be administered to the patient in a sterile condition. Thus, because these protein and carbohydrate solutions cannot be pre-compounded by the manufacturer but must be combined at the time of their use, their compounding must be performed under sterile conditions to avoid organism growth.

A known apparatus and process for compounding hyperalimentation solutions utilizes a solution transfer system including a plastic, receiving container and a Y-transfer set. A plastic container found to be particularly useful is one manufactured by Travenol Laboratories, Inc. of Deerfield, Ill. and marketed under the trademark VIAFLEX®.

A known Y-transfer set includes two separate tubes, each having an end attached to a common juncture by which solutions delivered through the tubes will pass through the juncture into the plastic container. The other end of one tube of the set is attached to the protein holding container and of the other tube of the set to the carbohydrate holding container. The desired volume of each solution being transferred to the container is controlled by a clamp placed on each tube. The solutions may be allowed to flow into the plastic container by gravity flow. However, it has been found to be useful to transfer them under the influence of a vacuum applied to the plastic container, which vacuum is created in a vacuum chamber into which the container is placed, such as the one manufactured by Travenol Laboratories, Inc. of Deerfield, Ill. and marketed under the trademark VIAVAC®.

It has been found in the past that to ensure sterility during the compounding of hyperalimentation solutions, compounding should be performed under a laminar flow hood. Laminar flow hoods are used for reducing the risk of airborne contamination of such solutions. These units operate by taking room air and passing it through a prefilter to remove gross contaminates, such as dust and lint. The air is then compressed and channeled through a bacterial retentive filter in the hood in a laminar flow fashion. The purified air flows out over the entire work surface of the hood in parallel lines at a uniform velocity. This type of filter is designed to remove all bacteria from the air being filtered. Compounding under a laminar flow hood aids in preventing airborne contamination, but it is relatively cumbersome and expensive and would not be useful for eliminating any other source of contamination, such as touch contamination. When using a hood, the operator may inadvertently perform the work at the end or outside of the hood and not at least six (6) within the hood to insure the benefits of the air being purified. Time must be taken and care must be exercised to maintain a direct open path between the filter and the compounding area. Solution bottles and other non-sterile objects cannot be placed at the back of the hood work area next to the filter because these objects could contaminate everything downstream and disrupt the laminar flow pattern of the purified air. Also, in using a laminar flow hood, it is necessary to routinely clean the work surface of the hood before any compounding is performed.

Thus, the prior art apparatus and process discussed above are disadvantageous because they require a laminar flow hood and more than one operation to both transfer and sterilize the mixture of the parenteral solutions.

These problems have been solved to some extent by the apparatus and process disclosed in Bellamy and Quick U.S. Pat. appln. Ser. No. 90,235, filed Nov. 1, 1979, the disclosure of which is incorporated by reference herein.

However, even when using the latter apparatus and process, new problems arise in connection with the filter of this apparatus. The viscosities of some of these parenteral solutions could cause filter clogging and, consequently, retard transfer through the filter and apparatus. Also, the viscosities of the solutions may be and are generally different, which could lead to an unequal or otherwise undesired mixture of them. Therefore, additional time and care must be exercised to ensure that the desired mixture of the solutions being combined is achieved. The process and apparatus of the present invention overcomes these various disadvantages.

Therefore, it is an object of the present invention to provide a process and apparatus for mixing at least two solutions, transferring the resulting mixture to a container, such as the plastic container mentioned above, and sterilizing that mixture during the transfer process.

Another object of the present invention is to provide a readily available process and apparatus which do not require the use of a laminar flow hood.

Finally, it is an object of the present invention to provide such a process and apparatus by which the desired composition of the transferred mixture is automatically controlled.

Other objects and advantages of the present invention will become apparent from the description thereof that follows.

SUMMARY OF THE INVENTION

In accordance with the present invention, an apparatus and process is provided for mixing at least two solutions in a pre-selected proportion and transferring the compounded mixture into a receiving container under sterile conditions. The apparatus includes the receiving container, a mixing chamber in fluid flow communication with a source of each solution, and means for automatically controlling the quantity of each solution in the compounded mixture. Further, the apparatus includes means for sterilizing the mixture transferred thereto from the chamber and for further transferring that sterilized mixture to the receiving container. One means is a sterile unit, which includes a filter in fluid flow communication with an outlet of the chamber, the receiving container, and tubing connected therebetween.

The mixing chamber serves three purposes. First, as its name suggests, the solutions delivered into it from the solution containers are mixed therein. Preferably, a baffle or other mixing member is provided in the chamber to increase the turbulence of the solutions and affect complete mixing thereof. Second, the mixing chamber and tubing provide a means by which the proportion of the different solutions being combined may be automatically controlled, so that the final mixture delivered to the sterile unit has the desired quantity of each solution. One means is multiple inlets into the chamber, each being adapted for connection with tubing through which a solution can be delivered into the chamber. Also, it is contemplated that another means is the particular size of the latter mentioned tubing. By the selection of the appropriate diameter and length of the tubing, a rate of flow of the solution delivered therethrough can be preselected in accordance with the viscosity of the solution, so that the quantity of each solution delivered to the chamber at a particular time can be preselected. Finally, another means is the provision of inlets of a preselected diameter, so that the quantity of a particular solution in the compounded mixture can be predetermined by the selection of a certain size inlet. Third, the mixing chamber provides a means by which the viscosity of the mixture to be transferred is reduced for faster transfer. Generally, the mixture viscosity will be less than the viscosity of the most viscous solution, which provides some savings in transfer time.

The process of the present invention includes the steps of delivering each of at least two solutions to the mixing chamber at a preselected, automatically controlled rate, mixing the solutions in the mixing chamber, and delivering the resulting mixture to the sterile unit, for sterilizing the mixture and transferring the sterilized mixture into the receiving container.

DETAILED DESCRIPTION OF THE ILLUSTRATIVE EMBODIMENTS

Figure 1:
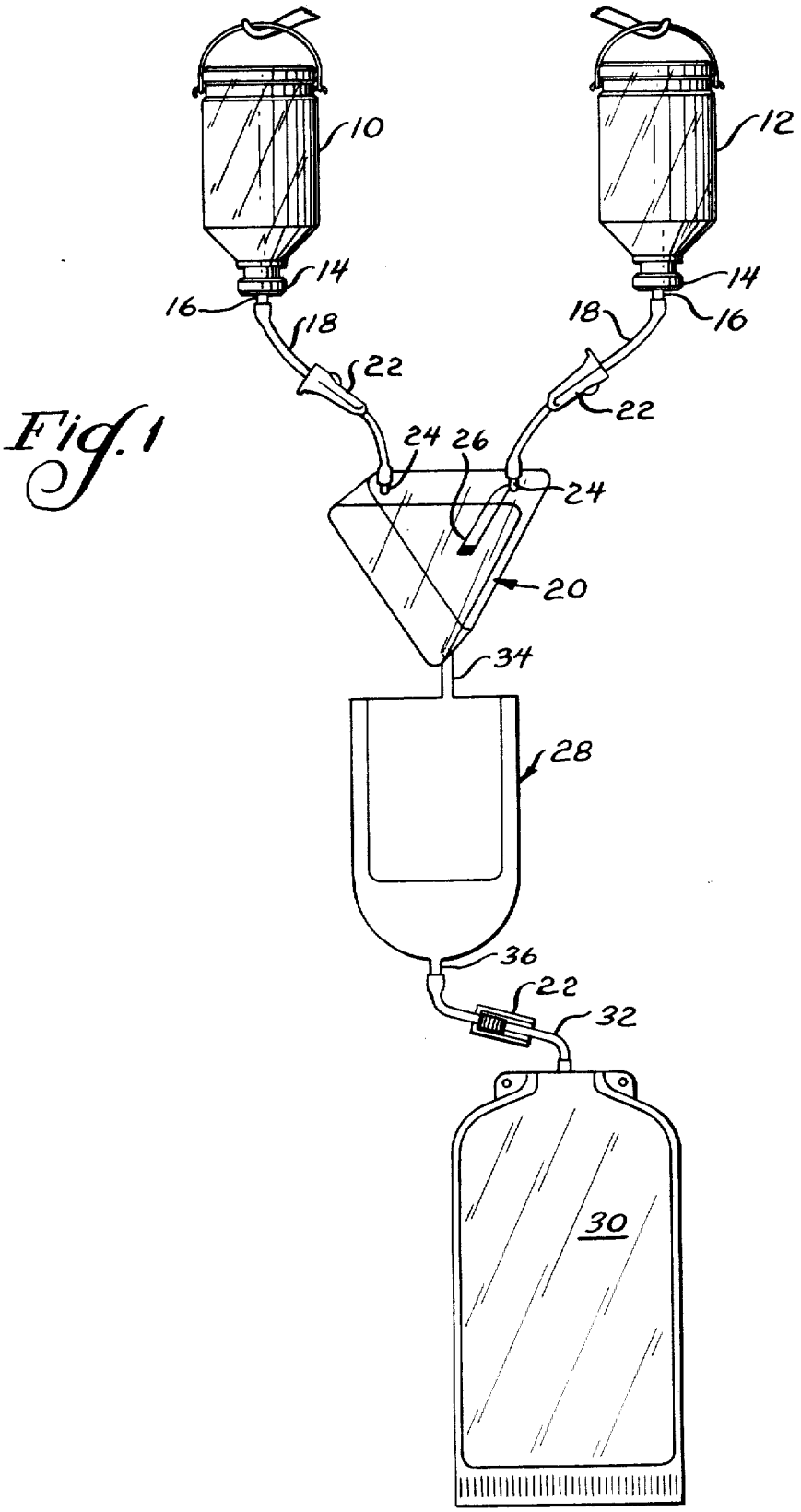
FIG. 1 is a perspective view of one embodiment of the apparatus of the present invention.

Referring to FIG. 1, there is shown a first solution container 10 and a second solution container 12. Generally these solution containers are made of glass. The containers each have a stopper 14 into which a spike 16 is inserted. Each spike is attached to one end of a tubing 18 by which the solution in the container can be transferred into a mixing chamber 20. A roller clamp 22 is provided on each tubing 18 for initiating and terminating the flow of solution through the tubing. An inlet 24 is provided in chamber 20 to which each tubing 18 associated with a solution container can be attached.

A baffle 26 is provided in the chamber. The baffle shown in FIG. 1 is attached to essentially the top of the chamber and helps increase the turbulence of the solutions to be combined for effecting complete mixing thereof.

Proceeding downwardly from mixing chamber 20, there is shown a sterile unit into which the resulting mixture of the solutions is delivered from the chamber for sterilization and transfer into a final receiving container. The sterile unit includes a filter 28, a plastic, extensible receiving bag 30, and tubing 32 for delivering the sterilized mixture to receiving bag 30. A roller clamp is also provided on tubing 32 for control of the rate of delivery of the mixture from the filter to the bag.

Filter 28 has an inlet 34 through which the mixture is delivered from chamber 20 into the filter and an outlet 36 to which is attached tubing 32. The filter is a sterilizing filter and is preferably a hydrophilic, bacterial organism retentive filter having a membrane surface area that is greater than one square inch and a maximum pore size of about 0.2 microns. Filters found to be particularly useful in the present invention are marketed by the Millipore Corp. of Bedford, Mass. under the trademark MILLIPORE. A flexible, plastic receiving bag found to be particularly useful in accordance with this invention is one marketed by Travenol Laboratories, Inc. of Deerfield, Ill. under the trademark VIAFLEX®.

In the operation of the apparatus of FIG. 1, each of the solution containers 10 and 12 hold a solution to be transferred. Chamber 20 and the tubing associated therewith are attached to the containers by the insertion of each spike 16 into a stopper 14 of one of the containers. Filter 28, tubing 32, and bag 30 are provided as a sterile unit. Inlet 34 of filter 28 is connected to chamber 20 and bag 32 is placed in a vacuum chamber. It has been found to be particularly useful to transfer parenteral solutions under the influence of vacuum, which accelerates the transfer process. A vacuum chamber found to be particularly useful is disclosed in U.S. Pat. No. 3,722,557. By the opening of the various clamps 22 shown in FIG. 1, the solutions in containers 10 and 12 flow into mixing chamber 20, where they are combined. The resulting mixture flows into filter 28, where it is sterilized, and the sterilized mixture then flows into bag 30. The bag is hermetically sealed by either the compression of tubing 32, the heat sealing of this tubing, or the heat sealing of the bag adjacent a point where tubing 32 connects with the bag. The actual operation of the various clamps and the vacuum chamber by which the solution transfer process is accomplished is well-known and need not be further discussed.

Turning more particularly to mixing chamber 20 and its structure and operation, the mixing chamber serves not only to allow for mixture of the solutions delivered from the solution holding containers, but also has means for controlling the amount of each solution being delivered into the chamber at a particular time, so that a preselected proportion of the different solutions is achieved before the resulting combined mixture is further transferred to the sterile unit. Therefore, the chamber provides a means for automatically controlling the solution compounding process.

Figure 2:
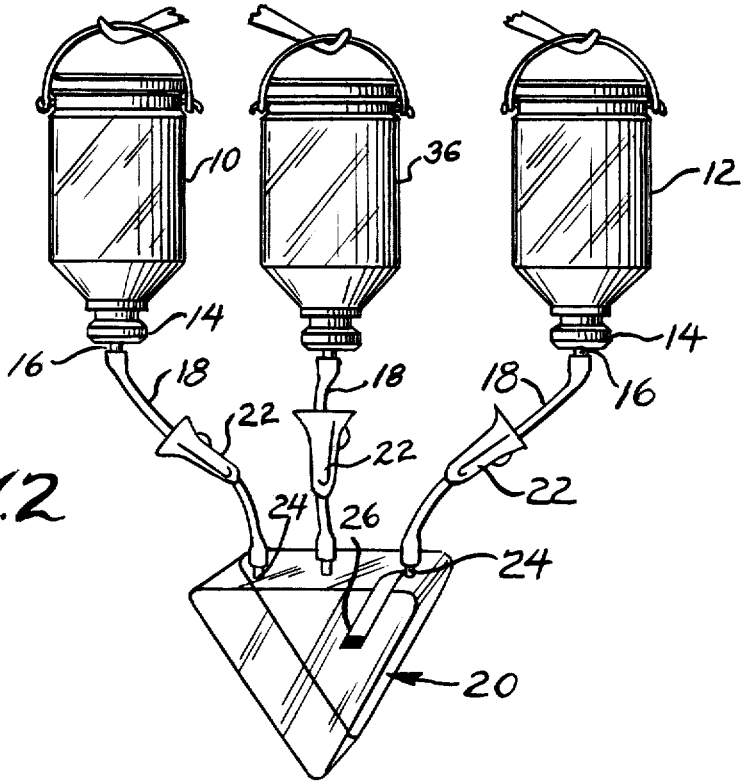
FIG. 2 shows a first modification thereof.
Figure 3:
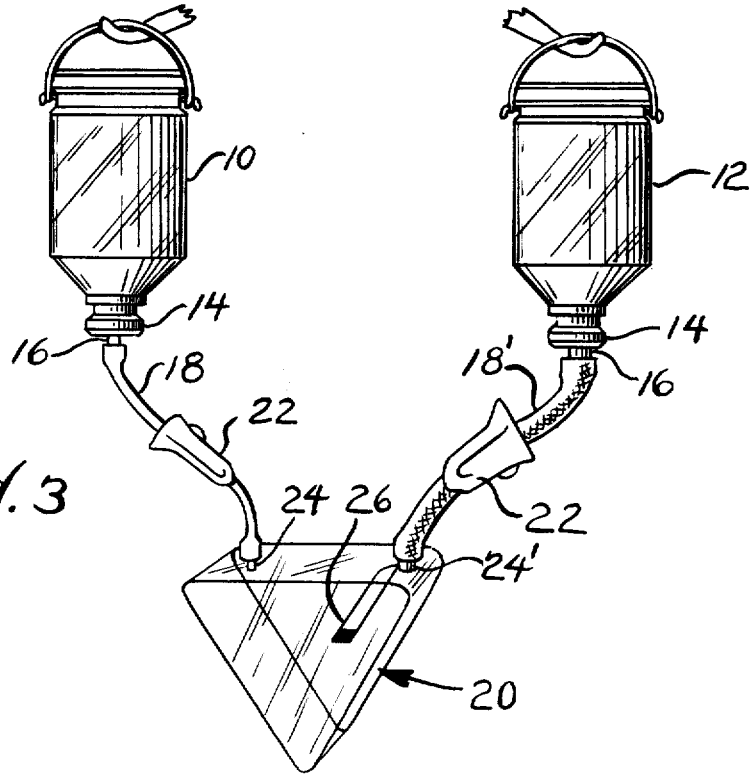
FIG. 3 shows a second modification thereof.

One means for controlling the proportion of the solutions being combined is the provision of three or more inlets as shown in FIG. 2. Generally, the solutions being delivered into the chamber have different viscosities. For example, because an amino acid solution is less viscous than a dextrose solution, to obtain the same amount of amino acid as dextrose in the final mixture, dextrose solution could be delivered to the chamber from solution containers 12 and 36, while only one amino acid solution from container 10 is delivered thereto. Another way that the proportion of the different solutions in the final mixture can be automatically controlled is illustrated in FIG. 3. In FIG. 3, tubing 18' has a greater internal diameter than tubing 18. Thus control is achieved by providing tubing of a particular length or diameter between one holding container and the chamber and tubing of a different length or diameter between the other holding container and the chamber. The chamber may also be provided with inlets of different sizes, as shown in FIG. 3. By preselecting the size of each inlet in accordance with the viscosity of the solution to be delivered therethrough, while at the same time either varying or maintaining uniform the size of all tubing and number of sources of each different solution, the flow rate into the chamber of any one kind of solution can be predetermined.

In a specific example, although no limitation is intended, a satisfactorily combined solution is provided by using a 24 inch tube 18 (FIG. 3) having an internal diameter of 0.13 inch with a ½ liter of 50 percent dextrose solution and a 24 inch tube 18' having an internal diameter of 0.2 inch with a ½ liter of 5.5 percent amino acid solution. The respective inlets 24 and 24' to chamber 20' have internal diameters of the same ratio.

Another advantage of having a mixing chamber into which the solutions to be compounded are delivered prior to their delivery to the sterile unit is that the transfer time between the solution holding containers and the final receiving bag is shortened. If, for instance, a dextrose solution and an amino acid solution were to be delivered through the apparatus, the faster flowing amino acid solution would reach the flexible receiving bag first. However, the total time for accomplishing the transfer operation would still be dependent on the time necessary for the transfer of the viscous, dextrose solution. If, however, the two solutions are mixed in the mixing chamber, the resulting mixture will be less viscous than the initial dextrose solution and the time for the mixture's transfer through the sterile unit will be less than would be the time for similarly transferring the dextrose solution through the sterile unit.

Modifications and other variations to the apparatus and process of the present invention described above are contemplated to be within the scope of this invention. For instance, the above described means for automatically controlling the quantity of each solution delivered into mixing chamber 20 can be modified so that not an equal amount of each solution is delivered into the chamber, but rather a preselected amount of each solution is delivered thereto.

If it facilitates the transfer operation, the mixing chamber, spikes and tubing associated therewith can also be included in the sterile unit. In that event, the operator would only have to attach each spike 16 to a solution holding container and place the plastic receiving bag into the vacuum chamber before the transfer operation could be begun. It is also intended that baffle 26 can be eliminated if adequate mixing of the solutions results or that more than one baffle can be used to effect increased mixing. It is also contemplated that the filter can be constructed to have a portion therein similar to chamber 20, which would allow for elimination of the separate mixing chamber.

What is claimed is:

1. An apparatus useful for the sterile compounding of at least two solutions comprising:

a container for receiving the compounded solutions;

a mixing chamber in fluid-flow communication with the receiving container and with the source of each solution;

a filter interposed in the fluid-flow communication between the mixing chamber and receiving container for sterilizing the mixture after it is mixed in the chamber;

tubing connected between the filter and the receiving container for delivery of the sterilized mixture to the receiving container;

wherein the solutions may be delivered to the mixing chamber, mixed therein, delivered to the filter, and then delivered to the receiving container and wherein at least the sterilizing portion of the filter, the tubing, and the receiving container are a sterile unit; and at least three uniform size tubes communicating with the mixing chamber for automatically controlling the quantity of each solution in the compounded mixture, each of said uniform size tubes being adapted for connection to a different solution source and through which the solution of the particular source can be delivered to the chamber, wherein the number of solution sources provided for a particular solution determines the quantity of that solution in the mixture.

2. An apparatus useful for the sterile compounding of at least two solutions comprising:

a container for receiving the compounded solutions;

a mixing chamber in fluid-flow communication with the receiving container and with the source of each solution;

a filter interposed in the fluid-flow communication between the mixing chamber and receiving container for sterilizing the mixture after it is mixed in the chamber;

tubing connected between the filter and the receiving container for delivery of the sterilized mixture to the receiving container;

wherein the solutions may be delivered to the mixing chamber, mixed therein, delivered to the filter, and then delivered to the receiving container and wherein at least the sterilizing portion of the filter, the tubing, and the receiving container are a sterile unit; and first and second tubes for automatically controlling the quantity of each solution in the compounded mixture, each tube communicating with said mixing chamber, being of a preselected size, and being adapted for transferring to said mixing chamber a solution from a particular solution source, wherein the size of the first and second tubes determines the amount of solution delivered through the tube and, consequently, the amount of that solution in the mixture.

3. An apparatus useful for the sterile compounding of at least two solutions comprising:

a container for receiving the compounded solutions;

a mixing chamber in fluid-flow communication with the receiving container and with the source of each solution;

a filter interposed in the fluid-flow communication between the mixing chamber and receiving container for sterilizing the mixture after it is mixed in the chamber;

tubing connected between the filter and the receiving container for delivery of the sterilized mixture to the receiving container;

wherein the solutions may be delivered to the mixing chamber, mixed therein, delivered to the filter, and then delivered to the receiving container and wherein at least the sterilizing portion of the filter, the tubing, and the receiving container are a sterile unit; and two inlets of different dimensions in said mixing chamber through each of which a solution from a solution source is delivered into said mixing chamber, for automatically controlling the quantity of each solution in the compounded mixture, wherein the dimension of each inlet determines the amount of solution delivered therethrough into said chamber and, consequently, the amount of that solution in the mixture.

4. The apparatus of claims 1, 2 or 3 wherein the mixing chamber further comprises at least one baffle for increasing the turbulence of and enhancing the mixture of the solutions being compounded.

5. A process for the sterile compounding of at least two solutions comprising the steps of:

delivering each solution from a solution source to a mixing chamber;

automatically controlling the quantity of each solution delivered to the chamber by providing at least three uniform size tubes communicating with the chamber, each of which is adapted for connection to a different solution source and through which the solution of the particular source can be delivered to the chamber, wherein the number of solution sources providing for a particular solution determines the quantity of that solution in the mixture;

mixing the solutions in the chamber;

sterilizing the mixture after it is mixed in the chamber by delivering the mixture to a filter in fluid-flow communication with an outlet of the chamber;

delivering the compounded mixture to a receiving container through tubing connected between an outlet of the filter and the receiving container, at least the sterilizing portion of the filter, the filter outlet, the tubing, and the receiving container being a sterile unit; and hermetically sealing the receiving container after the mixture has been received therein.

6. A process for the sterile compounding of at least two solutions comprising the steps of:

delivering each solution from a solution source to a mixing chamber;

automatically controlling the quantity of each solution delivered to the chamber by providing first and second tubes communicating with the chamber, being of a preselected size and being adapted for transferring to the chamber a solution from a particular solution source, wherein the size determines the amount of solution delivered through the tube and, consequently, the amount of that solution in the mixture;

mixing the solutions in the chamber;

sterilizing the mixture after it is mixed in the chamber by delivering the mixture to a filter in fluid-flow communication with an outlet of the chamber;

delivering the compounded mixture to a receiving container through tubing connected between an outlet of the filter and the receiving container, at least the sterilizing portion of the filter, the filter outlet, the tubing, and the receiving container being a sterile unit; and hermetically sealing the receiving container after the mixture has been received therein.

7. A process for the sterile compounding of at least two solutions comprising the steps of:

delivering each solution from a solution source to a mixing chamber;

automatically controlling the quantity of each solution delivered to the chamber by providing two inlets of different dimensions in the chamber through each of which a solution from one of the solution sources is delivered into the chamber, wherein the dimension of each inlet determines the amount of solution delivered therethrough into the chamber;

mixing the solutions in the chamber;

sterilizing the mixture after it is mixed in the chamber by delivering the mixture to a filter in fluid-flow communication with an outlet of the chamber;

delivering the compounded mixture to a receiving container through tubing connected between an outlet of the filter and the receiving container, at least the sterilizing portion of the filter, the filter outlet, the tubing, and the receiving container being a sterile unit; and hermetically sealing the receiving container after the mixture has been received therein.

8. The process of claims 5, 6 or 7 further comprising the step of providing at least one baffle in the chamber for increasing the turbulence of and enhancing the mixture of the solutions being compounded.

* * * * *